US005086959A

United States Patent [19]

Jerry et al.

[11] Patent Number: 5,086,959

[45] Date of Patent: Feb. 11, 1992

[54] BOOT JACK

[76] Inventors: George J. Jerry, 2602 Manila La., Houstin, Tex. 77043; Albert B. Fay, Jr., 5719 Indian Trail, Houston, Tex. 77057

[21] Appl. No.: 569,352

[22] Filed: Aug. 17, 1990

[51] Int. Cl.[5] ..... A47G 25/84; A47G 25/80

[52] U.S. Cl. ..... 223/114; 223/113; 223/111; 223/120; D2/642; D2/641

[58] Field of Search ..... 223/114, 113, 111, 118, 223/119, 120; D2/642, 641

[56] References Cited

U.S. PATENT DOCUMENTS

| | | | |
|---|---|---|---|
| 960,148 | 5/1910 | Bancroft | 223/114 |
| 1,089,600 | 3/1914 | Streeton | 223/114 |
| 1,296,565 | 3/1919 | Stone | 223/114 |
| 2,876,942 | 3/1959 | Johnson | 223/114 |
| 2,883,097 | 4/1959 | Scardamalia | 223/114 |
| 2,889,972 | 6/1959 | Johnson | 223/114 |
| 4,667,861 | 5/1987 | Harrington et al. | 223/113 |

FOREIGN PATENT DOCUMENTS

| | | | |
|---|---|---|---|
| 406463 | 3/1934 | United Kingdom | 223/113 |

*Primary Examiner*—Werner H. Schroeder
*Assistant Examiner*—Bibhu Mohanty
*Attorney, Agent, or Firm*—David A. Rose

[57] ABSTRACT

The boot jack includes a generally rectangular base having two bores in one end. A rod-like member forms a V-shaped stirrup having portions extending vertically and horizontally with respect to the base so as to form a loop. The ends of the horizontally extending portions are inserted into the bores for attaching the rod-like member to the base. The base is maintained horizontally while the rod-like member provides an incline for the V-shaped stirrup. The rod-like member is preferably made of mild steel so as to provide a spring action in gripping the heel of the boot.

14 Claims, 3 Drawing Sheets

FIG. 1
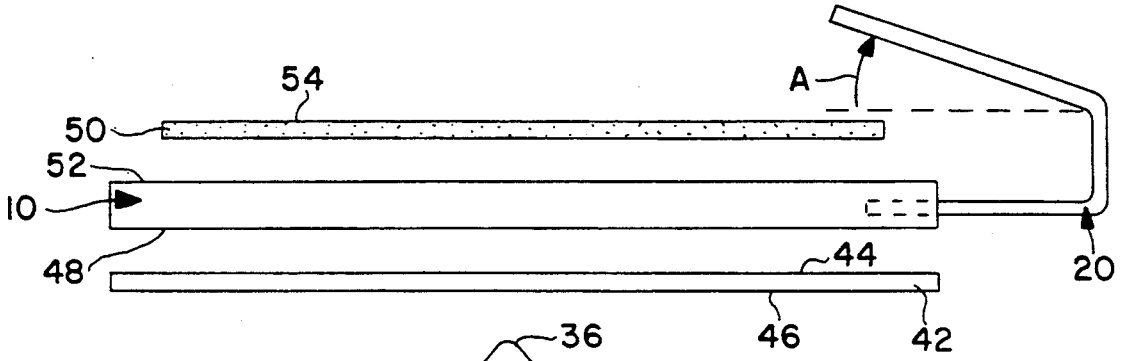
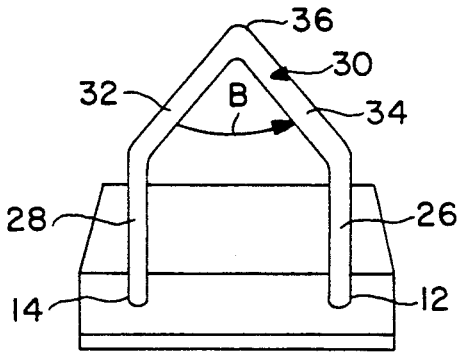
FIG. 2
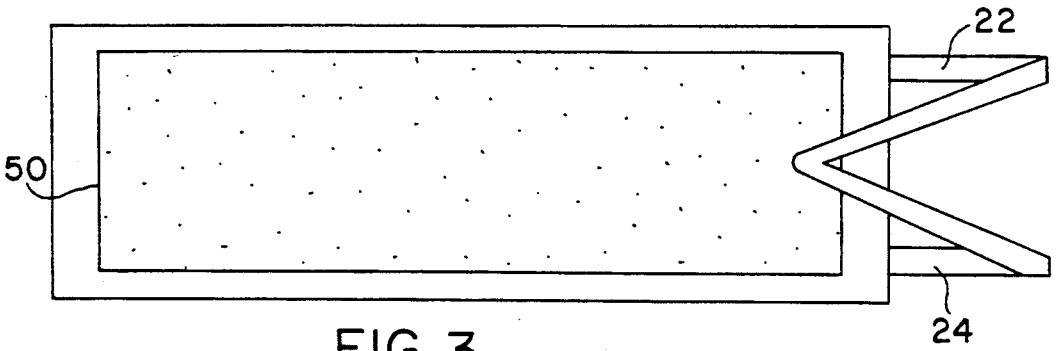
FIG. 3

FIG. 7
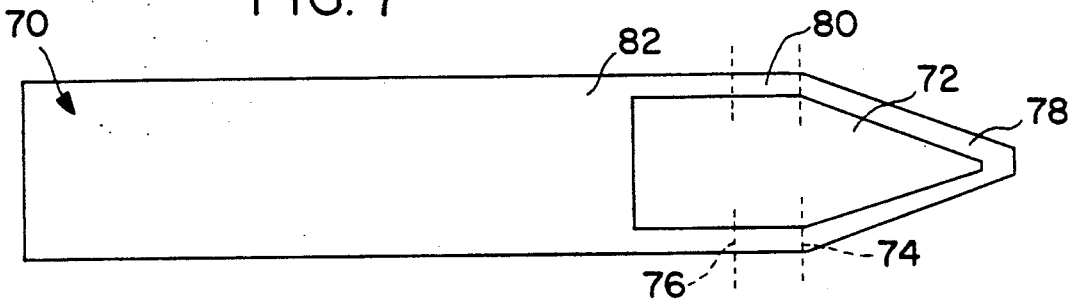
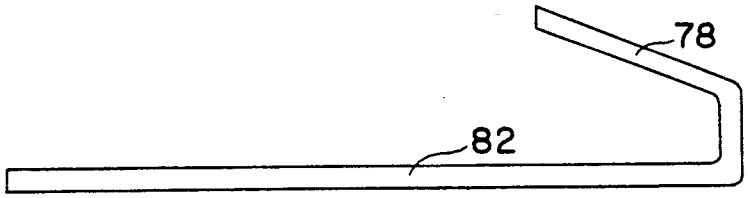
FIG. 8
FIG. 9
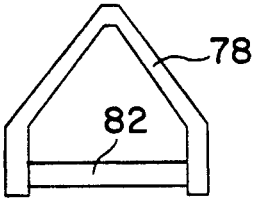
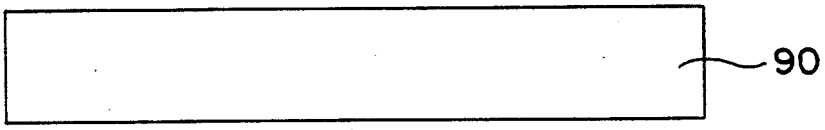
FIG. 10

BOOT JACK

BACKGROUND OF IN THE INVENTION

The present invention relates to clothing accessories and more particularly to boot jacks for the removal of boots.

Prior art boot jacks include an inclined board having a V-shaped notch in its upper end and a vertical support underneath causing the incline. The wearer places one foot on the inclined board and inserts his boot into the V-shaped notch. Often the V-shaped notch of the inclined board is lined with leather or the like which frictionally engages the heel of the boot. The wearer then lifts his leg with the boot and leans backward while balancing his other foot on the inclined board.

The use of the prior art boot jack places the user in a very vulnerable position since it is necessary for the balance foot to be anchored while attempting to lift the other foot and simultaneously lean backward. Standing in this awkward position, the user may lose his balance as he attempts to raise his leg and lean backward. Also, the inclined board many times is too short requiring that the feet be close together thus limiting the user's ability to maintain his balance. Further, the inclined board of prior art boot jacks tend to have a slippery surface causing the user to slip off the boot jack. Still further, the V-shaped notch of prior art boot jacks can damage the leather of the boot as the notch bites into the heel of the boot.

The present invention overcomes the deficiencies of the prior art.

SUMMARY OF THE INVENTION

The present invention includes a generally rectangular, horizontal base having two generally parallel bores in one end. A rod-like member forms a V-shaped stirrup with portions extending vertically downwardly and horizontally toward the base. The ends of the horizontally extending portions are received by the bores of the base to attach the rod-like member to the base. The base is adapted to lie flat on the floor such that the user need not stand on an inclined plane. Further, the rod-like member is preferably a metal rod which has a spring action that grips the heel of the boot without damaging the boot. The stirrup extends upwardly at a preferred angle to permit the user to merely raise his leg to remove the boot rather than both raising his leg and leaning backward so as to lose his balance.

Other objects and advantages of the invention will appear from the following description.

DESCRIPTION OF THE DRAWINGS

For a detailed description of the preferred embodiment of the invention, reference will now be made to the accompanying drawings wherein:

FIG. 1 is a side elevation view of the boot jack of the present invention showing portions thereof in an exploded view;

FIG. 2 is a prospective view of the end of the boot jack shown in FIG. 1;

FIG. 3 is a top view of the boot jack shown in FIG. 1;

FIG. 7 is the top view of the boot jack of FIG. 1 made from a single piece of plastic and prior to the forming of the stirrup;

FIG. 8 is a side elevation view of the plastic boot jack of FIG. 7 with the stirrup bent into position;

FIG. 9 is an end elevation view of the plastic boot jack of FIG. 8; and

FIG. 10 is a top view of a Mylar film strip used with the boot jack of FIG. 1.

DESCRIPTION OF THE PREFERRED EMBODIMENT

Figure 4:
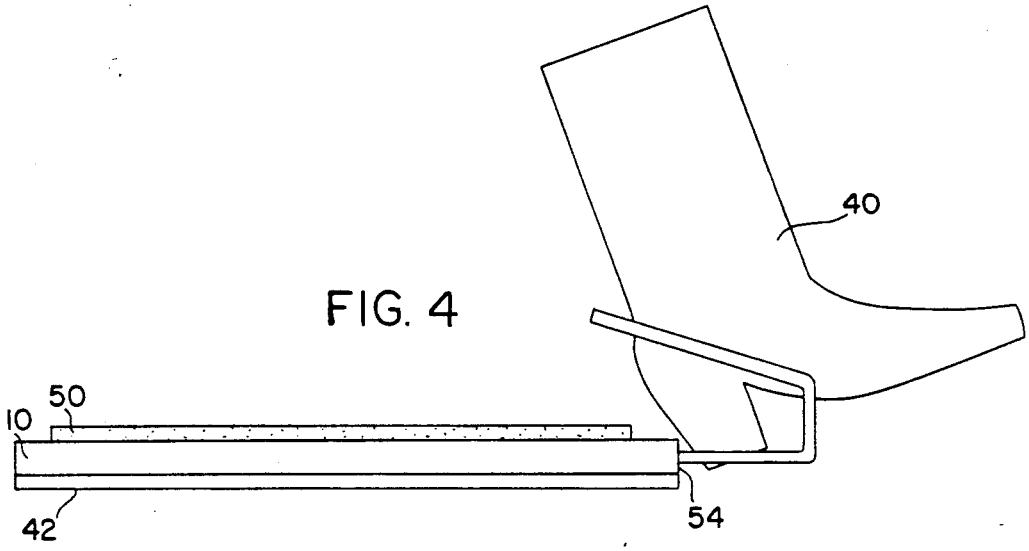
FIG. 4 is a side elevation view of the boot jack of FIG. 1 illustrating the insertion of a boot.

Referring initially to FIGS. 1, 2, and 3, the boot jack of the present invention includes a base 10 and a rod-like member 20. The base !0 is generally rectangular and is preferably made of wood and more preferably made from one of the hardwoods although the base 10 may be made from other materials, such as plastic or metal, sufficient to support the weight of the user and support the rod-like member 20 as hereinafter described.

The rod-like member 20 is preferably a integral metal rod bent or formed to have a pair of horizontal portions 22, 24, a pair of vertical portions 26, 28, and a pair of converging, inclined portions 32, 34 meeting at apex 36 forming gripping means or stirrup 30. A V-shaped notch is formed by converging, inclined portions 32, 34.

The rod-like member 20 is preferably made from 5/16 inch metal rod which provides a preferred spring action for stirrup 30. A ⅜ inch diameter rod is less preferred since it does not have the preferred spring action for stirrup 30. A ¼ inch metal rod is also less preferred since the smaller rod has a tendency to bend and distort from its preferred shape upon use.

The rod-like member 20 is preferably made of a metal such as mild steel. A mild steel rod of 5/16 inch diameter provides the spring action preferred for the grip of stirrup 30. The rod-like member 20 is preferably made of a polished mild steel and possibly chrome, such that the stirrup 30 will not mar or burnish the heel of the boot. Further, the metal rod-like member 20 will not make noises upon the insertion of a boot as does the case of leather on leather used with prior art boot jacks.

The ends of horizontally extending portions 22, 24 are inserted into bores 12, 14, respectively, in the end of base 10. The bores 12, 14 are approximately 3 inches deep and are preferably of the same diameter as rod-like member 20. In the preferred embodiment, the bores 12, 14 are 5/16 inches in diameter. The close tolerances are utilized to avoid the use of any glue or adhesive for the attachment of rod-like member 20 to base 10. In the assembly of rod-like member 20, member 20 is preferably driven into bores 12, 14 like a nail.

The boot jack of the present invention has preferred dimensions. The base 10 may be 10 to 20 inches long but preferably is 16 inches long and 6 inches wide, with a nominal height of ¾ inch. The base 10 must have a thickness or height sufficient for bores 12, 14. The length of horizontally extending portions 22, 24 may be ½ to 5 inches with a preferred length of 3 inches and the height of vertically extending portions 26, 28 is preferably 2½ inches. The distance between horizontally extending portions 22, 24 and vertically extending portions 26, 28 is preferably 4½ inches on center. The converging, inclined portions 32, 34 have a preferred length of 6 to 7 inches forming the apex 36 with a preferred radius of ⅛ inch to the center of rod-like member 20. These dimensions allow the insertion of the typical adult boot including ladies boots with extended high heels.

The converging, inclined portions 32, 34 form a preferred incline angle A with the horizontal in the range of −14 degrees below the horizontal to 45 degrees above the horizontal, preferably at an angle of 23.5 degrees above the horizontal. The preferred jam angle B formed by converging, inclined portions 32, 34 and apex 36 is in the range of 28 to 72 degrees and is preferably 36 degrees, i.e. one-tenth of a circle. The incline angle A, together with the height of vertically extending portions 26, 28 and the length of converging, inclined portions 32, 34, causes the apex 36 of stirrup 30 to have a height of approximately 4½ inches above the upper surface 52 of base 10 allowing the insertion of the heel of the boot.

Referring now to FIG. 4, the radius of apex 36 and jam angle B forming the V-shaped notch by stirrup 30 causes a crisp bite by stirrup 30 of the heel of boot 40. The radius of apex 36 is preferably ⅛ inch although a radius of ½ inch is satisfactory. The rod-like member 20 initially deflects upon the insertion of boot 40 and then returns to its normal position upon the removal of the boot 40. The sharper the bend at apex 36, i.e. the smaller the radius of apex 36, the crisper the bite on boot 40 by stirrup 30 and the better the spring action of rod-like member 20.

Referring again to FIGS. 1–3, the boot jack of the present invention may also include a bottom mat 42 made of a thin rubber membrane. The mat 42 may be die cut. The top surface of mat 42 is glued to the bottom surface 48 of base 10 with an appropriate adhesive. The bottom mat 42 preferably covers the entire bottom surface 48 of base 10. As an alternative, two strips of thin rubber membrane may be affixed onto the bottom surface 48 across the front and back widths of base 10. The bottom surface 46 of mat 42 may be dimpled to add additional gripping to mat 42. Thus, the bottom mat 42 prevents any sledding action of the boot jack and is therefore safer for the user.

The boot jack of the present invention may also include a top pad 50 made of a spongy, latex rubber material. As shown in FIG. 3, the top pad 50 need not cover the entire top surface 52 of base 10 and may, for example, only cover two-thirds of the surface area 52. The top pad 50 is likewise glued by an appropriate adhesive to the top surface 52 of base 10. The top pad 50 serves as a cushion surface for the user's foot.

As illustrated in FIG. 4, the boot 40, to be removed, is inserted into the stirrup 30 while the anchor foot is placed onto the top of top pad 50 of base 10. The bottom mat 4 grips the floor due to the weight of the user standing on base 10. As shown in FIG. 4, the base 10 lies flat on the surface of the floor and is therefore generally horizontal as distinguished from the inclined plane of prior art boot jacks. In the horizontal position, base 10 grips the floor area along its entire bottom surface and does not rock or tetter as is in the case of prior art boot jacks. Thus, as distinguished from prior art boot jacks, the user is able to stand in an upright position thereby maintaining his balance.

The rod-like member 20 provides a slight spring action which is not noticeable to the eye. Although the deflection is not apparent, the spring action grips the heel of the boot 40 to prevent the boot 40 from slipping out of the V-shaped notch formed by stirrup 30. This spring action causes the metal rod-like member 20 to maintain its grip of the boot 40. The rod-like member 20 is narrow as compared to prior art wood V-shaped notches and therefore maintains the gripping action.

The rod-like member 20 provides the change in plane for the gripping of boot 40. The angle A is optimal at 23.5 degrees. At that preferred angle, the user need only allow the stirrup 30 to grip boot 40 at a cocked angle, raise his leg and straighten his ankle to remove the foot from the boot 40. The movement of the user to remove the foot is a much more upward movement than the upward and backward movement required by prior art boot jacks. If the jam angle is too shallow, the foot is too vertical to slip out of the boot 40 easily. The boot jack of the present invention has taken into consideration the architecture of boot 40 and the ergonomics of the user's legs. The rod-like member 20 in providing the plane change for the boot jack and extending away from the leading edge 54 of base 10, prevents the heel of the boot 40 from dragging across the leading edge 54 and therefore does not damage the heel of boot 40.

Rod-like member 20 also forms a loop on base 10. This feature provides the added advantage of allowing the user to insert the toe of his shoe or boot and lift the boot jack to move it easily.

Figure 5:
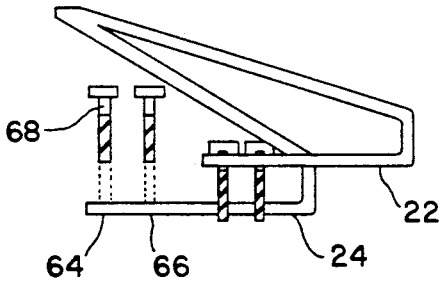
FIG. 5 is a generally side prospective view of an alternative embodiment of the rod-like member shown in FIG. 1.
Figure 6:
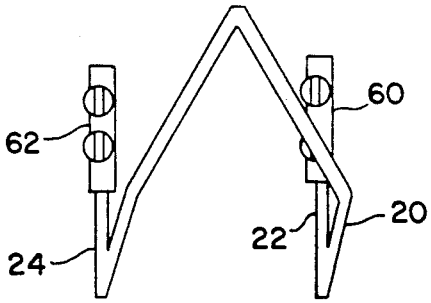
FIG. 6 is a generally top prospective view of the rod-like member shown in FIG. 5.

Referring now to FIGS. 5 and 6, the rod-like member 20 may be fastened directly to the supporting surface, such as a wood floor, so as to be able to dispense with the base 10 since the floor serves as the support for rod-like member 20. The horizontally extending portions 22, 24 are flattened at 60, 62, respectively, and each include a pair of apertures 64, 66 which receive a pair of fasteners 68, such as screws, to attach the rod-like member 20 to the floor.

Referring now to FIGS. 7-9, the boot jack of the present invention may be made of molded plastic. A one-piece molded plastic member 70 is shown. Plastic member 70 includes a cutout portion 72 forming a plastic version 80 of rod-like member 20. The plastic is heated at locations 74, 76 on both sides of member 80 to allow stirrup 78 to be folded back over the base 82 as shown in FIGS. 8 and 9. Alternatively, the boot jack of FIGS. 7–9 may be made of one molded piece. Further, the boot jack may be made from laminated wood with the rod-like member 20 being formed by steam molding.

Referring now to FIG. 10, there is shown a foot insertion aid 90 made of a strip of plastic film, preferably polyester film with a width of between 2 and 2½ inches. The foot insertion aid 90 has a width approximating the width of the vamp of a normal boot. The length of strip 90 is preferably 2 feet. Foot insertion aid 90 is preferably manufactured in a roll with perforations every 2 feet such that the user may tear lengths of the foot insertion aid 90 from the roll for the purpose of inserting his feet into new boots. The foot insertion aid 90 is preferably 1½ to 2 mils thick to provide it with the necessary durability such that it will not tear or distend upon its removal by the user.

In operation, the user places the foot insertion aid 90 into the barrel and toe of the new boot. The excess film is folded over the front of the boot. The user then slips his foot and ankle beneath the foot insertion aid 90 such that the foot insertion aid 90 covers the top of the user's foot and ankle. The reduced friction surface of the foot insertion aid 90 allows the user's foot and ankle to slide easily into the barrel and vamp of the boot. The foot insertion aid 90 permits the user's foot to easily ease around the corner of the barrel and vamp of the boot so that his foot slides into the toe of the boot. The foot insertion aid 90 may be removed by merely pulling on the top of the strip to permit it to slide between the boot and the user's foot and ankle.

While a preferred embodiment of the present invention has been shown and described, modifications thereof can be made by one skilled in the art without departing from the spirit of the invention.

We claim:

1. An apparatus for removing a boot, comprising:

a horizontal base;

a gripping means forming a V-shaped notch supported at an angle above said horizontal base for receiving the heel of the boot; said notch having an apex and a open mouth for receiving the boot, said apex of said notch being angled upwardly and positioned rearwardly of said mouth.

2. An apparatus for removing a boot with a heel, comprising:

a base having two bores in one end;

a rod-like member forming a V-shaped notch with vertically and horizontally extending portions with respect to said base, said bores receiving said horizontally extending portions for attaching said rod-like member to said base;

said notch having an apex and a open mouth for receiving the boot, said apex being angled upwardly and positioned rearwardly above said mouth; and said vertically and horizontally extending portions positioning said mouth such that said mouth receives and holds the heel of the boot above and in front of said base.

3. The apparatus of claim 2 wherein said V-shaped notch is formed by two upwardly above, inclined portions meeting at said apex.

4. The apparatus of claim 3 wherein said V-shaped notch forms a jam angle of 28 to 72 degrees between said two upwardly converging, inclined portions.

5. The apparatus of claim 4 wherein said jam angle is preferably 36 degrees.

6. The apparatus of claim 2 wherein said V-shaped notch forms an incline angle of 23.5 degrees with an upper surface of said base.

7. The apparatus of claim 2 wherein said rod-like member has a spring action.

8. The apparatus of claim 7 wherein said rod-like member is made of a metal rod which has a coating.

9. The apparatus of claim 2 further including a non-slip surface on the bottom of said base.

10. The apparatus of claim 2 further including a cushion surface on the top of said base.

11. A boot holder for attaching to a horizontal surface for receiving and holding a boot, comprising:

a rod-like member having two parallel horizontal portions, two parallel vertical portions, and two converging, inclined portions forming a V-shape;

said parallel horizontal portions having apertures therethrough adapted to receive fasteners;

said two converging, inclined portions having an apex and a open mouth for receiving the boot, said apex being angled upwardly and positioned rearwardly said mouth and extending over said two parallel horizontal portions.

12. The boot holder of claim 10 wherein said parallel horizontal portions have parallel flat surfaces through which said apertures extend.

13. An apparatus for removing a boot, comprising:

a plastic rectangular member having a cut-out portion forming parallel straight portions and a V-shaped portion forming a notch;

said parallel straight portions each being heated at predetermined locations and bent at said locations to form a pair of horizontal portions, a pair of vertical portions, and extending said notch at an angle to said rectangular member; and said notch having an apex and a open mouth for receiving the boot, said apex being angled upwardly and positioned rearwardly above said mouth.

14. An apparatus for removing a boot, comprising:

a rectangular member made of wood having a cut-out portion forming parallel straight portions and a V-shaped portion forming a notch;

said parallel straight portions each being steamed at predetermined locations and bent at said locations to form a pair of horizontal portions, a pair of vertical portions, and extending said notch at an angle to said rectangular member; and said notch having an apex and a open mouth for receiving the boot, said apex being angled upwardly and positioned rearwardly said mouth.

* * * * *